US007300294B2

(12) United States Patent
Fukatsu et al.

(10) Patent No.: US 7,300,294 B2
(45) Date of Patent: Nov. 27, 2007

(54) CONNECTOR AND CONNECTOR ASSEMBLY OF THE MOVABLE MEMBER TYPE

(75) Inventors: Yukihiro Fukatsu, Yokkaichi (JP); Toshikazu Sakurai, Yokkaichi (JP); Masayasu Fujii, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/452,746

(22) Filed: Jun. 14, 2006

(65) Prior Publication Data

US 2006/0286834 A1 Dec. 21, 2006

(30) Foreign Application Priority Data

Jun. 15, 2005 (JP) ..... 2005-175262

(51) Int. Cl.
*H01R 13/62* (2006.01)

(52) U.S. Cl. ..... 439/157; 439/587

(58) Field of Classification Search ..... 439/157, 439/587, 589, 274, 275, 271
See application file for complete search history.

(56) References Cited

U.S. PATENT DOCUMENTS 6,551,118 B2 * 4/2003 Langolf et al. ..... 439/157
6,623,286 B2 * 9/2003 Tachi ..... 439/157
6,733,313 B2 * 5/2004 Shinozaki et al. ..... 439/157
6,755,674 B2 * 6/2004 Fujii et al. ..... 439/157
2002/0004326 A1 1/2002 Mochizuki
2002/0019156 A1 * 2/2002 Fukamachi et al. ..... 439/157
2003/0162427 A1 8/2003 Shinozaki et al.
2003/0199185 A1 10/2003 Fujii et al.

FOREIGN PATENT DOCUMENTS

GB 2 322 242 8/1998
JP 2001-326024 11/2001

* cited by examiner

*Primary Examiner*—Hien Vu
(74) *Attorney, Agent, or Firm*—Gerald E. Hespos; Anthony J. Casella

(57) ABSTRACT

A female housing (10) has a lever (12) to facilitate connection with a male housing (11). An operable portion (43) of the lever (12) is at a lateral end of the female housing (10) immediately before the housings (10; 11) are connected and is operated along a connecting direction of the male housing (11). An engaging portion (53) is formed at an end of the lever (12) opposite the operable portion (43) and is engageable with a locking projection (52) on the male housing (11) immediately before the housings (10, 11) are connected properly. Thus, the locking projection (52) receives a force acting along the connecting direction of the male housing (11) as the lever (12) is rotated. In this way, the posture of the female housing (10) is corrected, enabling the two housings (10, 11) to be connected in their proper postures.

7 Claims, 10 Drawing Sheets

CONNECTOR AND CONNECTOR ASSEMBLY OF THE MOVABLE MEMBER TYPE

BACKGROUND OF THE INVENTION

1. Field of the Invention

The invention relates to a connector with a movable member, such as a lever.

2. Description of the Related Art

Japanese Unexamined Patent Publication No. 2001-326024 discloses a lever-type connector assembly with male and female housings that can be connected to one another. A lever is mounted rotatably on the female housing and is formed with cam grooves. Cam pins are formed on the male housing and can be received in the cam grooves of the lever. The cam pins move along cam grooves as the lever is rotated to pull the housings together. An operable portion of the lever is radially distanced from an axis of rotation. The operable portion is near a side of the female housing immediately before the two housings, are connected properly and is operated in a direction along a connecting direction of the female housing.

The side of the female housing that is near the operable portion of the lever immediately before the housings are connected properly is pushed along the connecting direction of the female housing as the lever is rotated. Thus, there are cases where a connected state of the side near the operable portion of the lever precedes the side of the housing opposite to the operable portion of the lever, resulting in an inclined posture.

The invention was developed in view of the above problem and an object thereof is to correct the posture of one housing in the process of connecting the two housings.

SUMMARY OF THE INVENTION

The invention relates to a connector with a housing and a movable member mounted movably on the housing. The movable member has a side plate and an operable portion on the side plate. The movable member has at least one cam engageable with at least one mating cam on a mating housing so that the mating cam can be guided along the cam as the movable member is operated to connect the housing with the mating housing. An engaging portion is formed on an end of the movable member substantially opposite the operable portion and is engageable with a locking projection on the mating housing immediately before the housing is connected properly with the mating housing. Thus, the engaging projection exerts a force on the locking projection along a connecting direction of the mating housing as the movable member is operated.

The side of the housing near the operable portion of the movable member may precede the side opposite to the operable portion of the operable member immediately before the housings are connected properly. However, the engaging portion at the side of the movable member opposite the operable portion exerts a force on the locking projection substantially along the connecting direction. Thus, the posture of the housing can be corrected so that the two housings can be connected in their substantially proper postures.

The movable member preferably is a lever mounted rotatably to the housing and the operable portion of the movable member is at a side of the housing radially distanced from an axis of rotation of the movable member.

The movable member preferably moves along a connecting direction of the housing immediately before the housings are connected properly.

The housing preferably is a harness-side housing to be connected with wires of a wiring harness, and the mating housing preferably is a waiting-side housing to be disposed on a fixed member.

At least one guiding wall preferably is formed near an end surface of the housing that is to be connected with the mating housing. The guiding wall is at a position substantially corresponding to the locking projection of the mating housing, and extends substantially in the connecting directions of the two housings. Thus, the guiding wall slides in contact with the locking projection during a connecting operation of the two housings, and the two housings can be connected and separated in substantially proper postures.

The movable member preferably is mountable to the housing in two substantially transversely symmetrical postures, and two locking projections are formed at two transversely symmetrical positions on the mating housing. Accordingly, operation efficiency is improved because the mounting posture of the movable member can be selected freely to avoid any restriction on an operating space of the movable member.

At least two supporting shafts are formed at substantially transversely symmetrical positions with respect to the housing. The movable member is mounted rotatably on one of the supporting shafts, and can be mounted in two substantially transversely symmetrical postures on the housing.

The operable portion of the movable member mounted on the first supporting shaft preferably is at a side of the first supporting shaft opposite to the second supporting shaft immediately before the housings are connected properly.

Two cam pins preferably are formed on the mating housing at positions corresponding to the cam groove of the movable member in the respective states where the movable member is mounted on the first supporting shaft. The cam pin that is not engaged with the cam groove functions as the locking projection. Thus, the construction of the mating housing can be simplified as compared to a case where the locking projection is separate.

The invention also relates to a connector assembly comprising the above-described connector and a mating connector with the mating housing. The locking projection is formed on the mating housing.

Two mating cams preferably are formed on the mating housing at positions corresponding to the cam of the movable member in the respective states of the movable member on one of the supporting shafts.

The mating cam that is not engaged with the cam preferably functions as the locking projection.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector according to a first embodiment of the invention is described with reference to FIGS. 1 to 9. The connector has a female housing. 10 and a male housing 11 that can be connected and separated by a lever on the female housing 10. The female and male housings 10, 11 are to be connected along a connecting direction CD. In the following description, ends of the two housings 10, 11 to be connected are referred to as front ends and reference is made to FIG. 2 concerning vertical direction.

Figure 2:
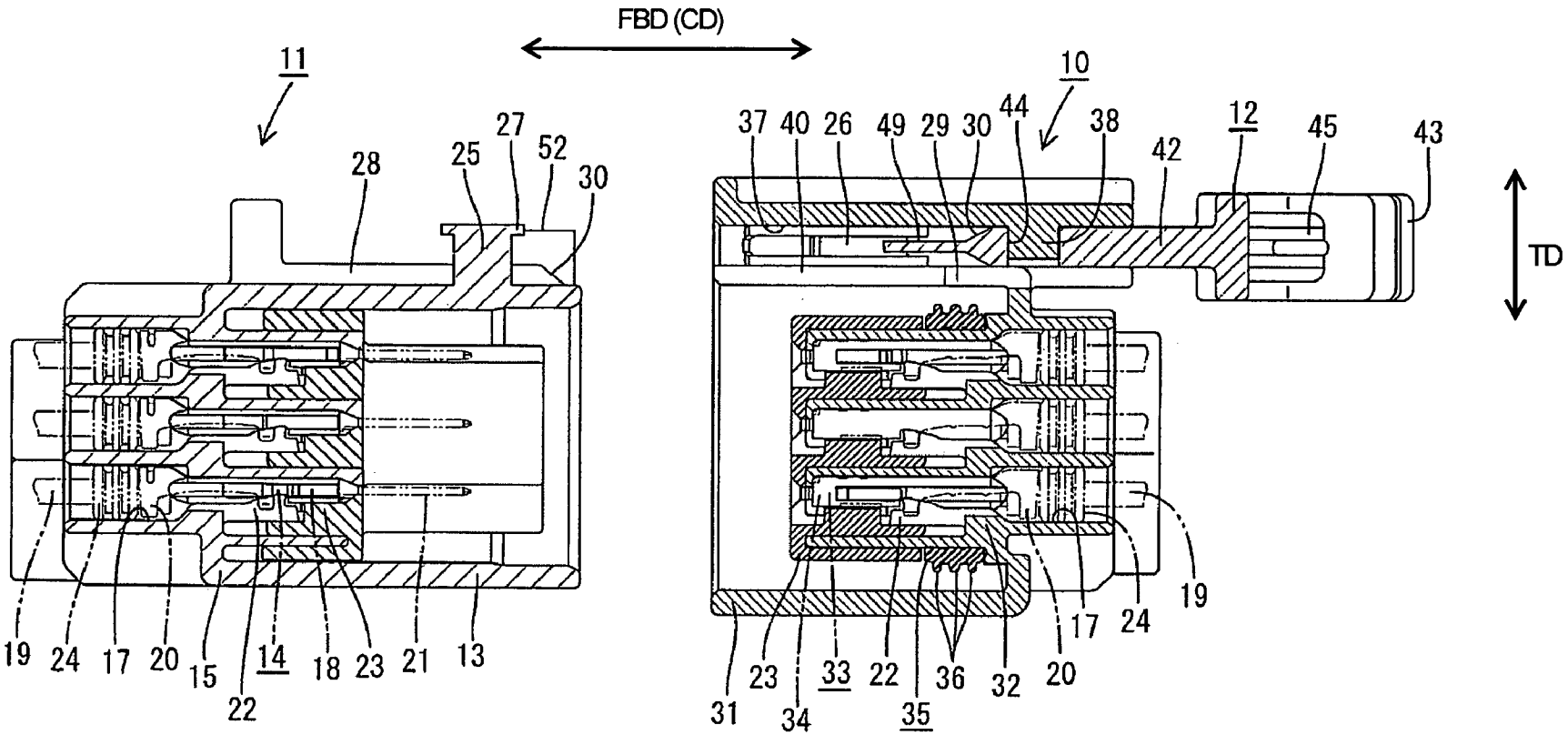
FIG. 2 is a side view in section showing a male housing and a female housing of the first embodiment.
Figure 3:
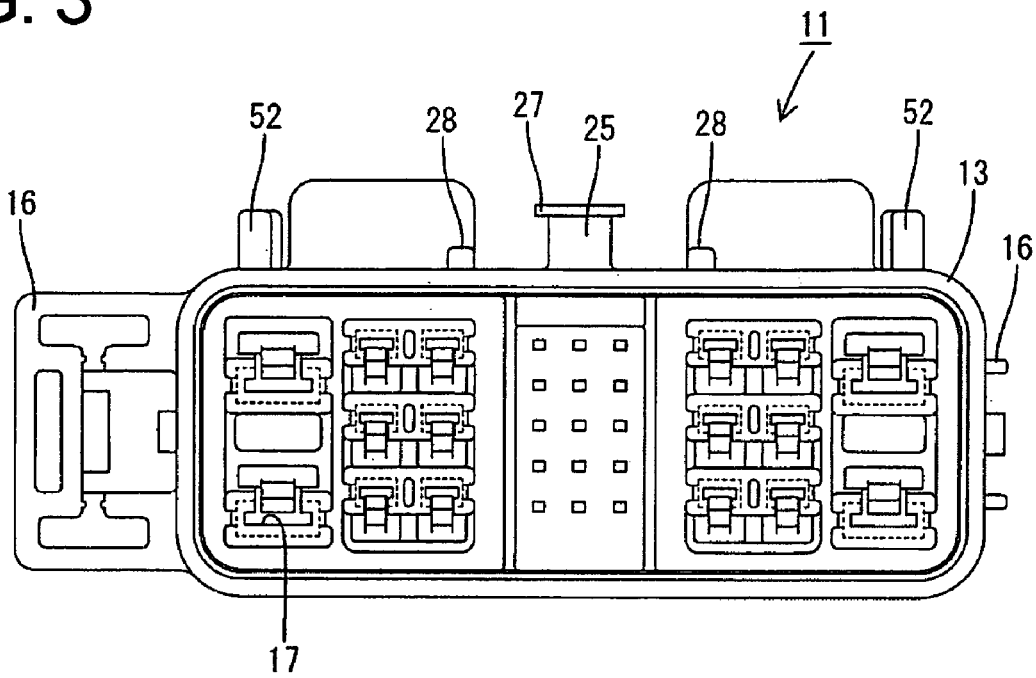
FIG. 3 is a front view of the male housing of the first embodiment.

The male housing 11 is made e.g. of a synthetic resin and is a waiting-side housing arranged on an unillustrated fixed member, as shown in FIGS. 2 and 3. A forwardly open receptacle 13 is formed at a front end of the male housing 11, and a terminal accommodating portion 15 is formed behind the receptacle 13 for accommodating male terminal fittings 14.

Figure 1:
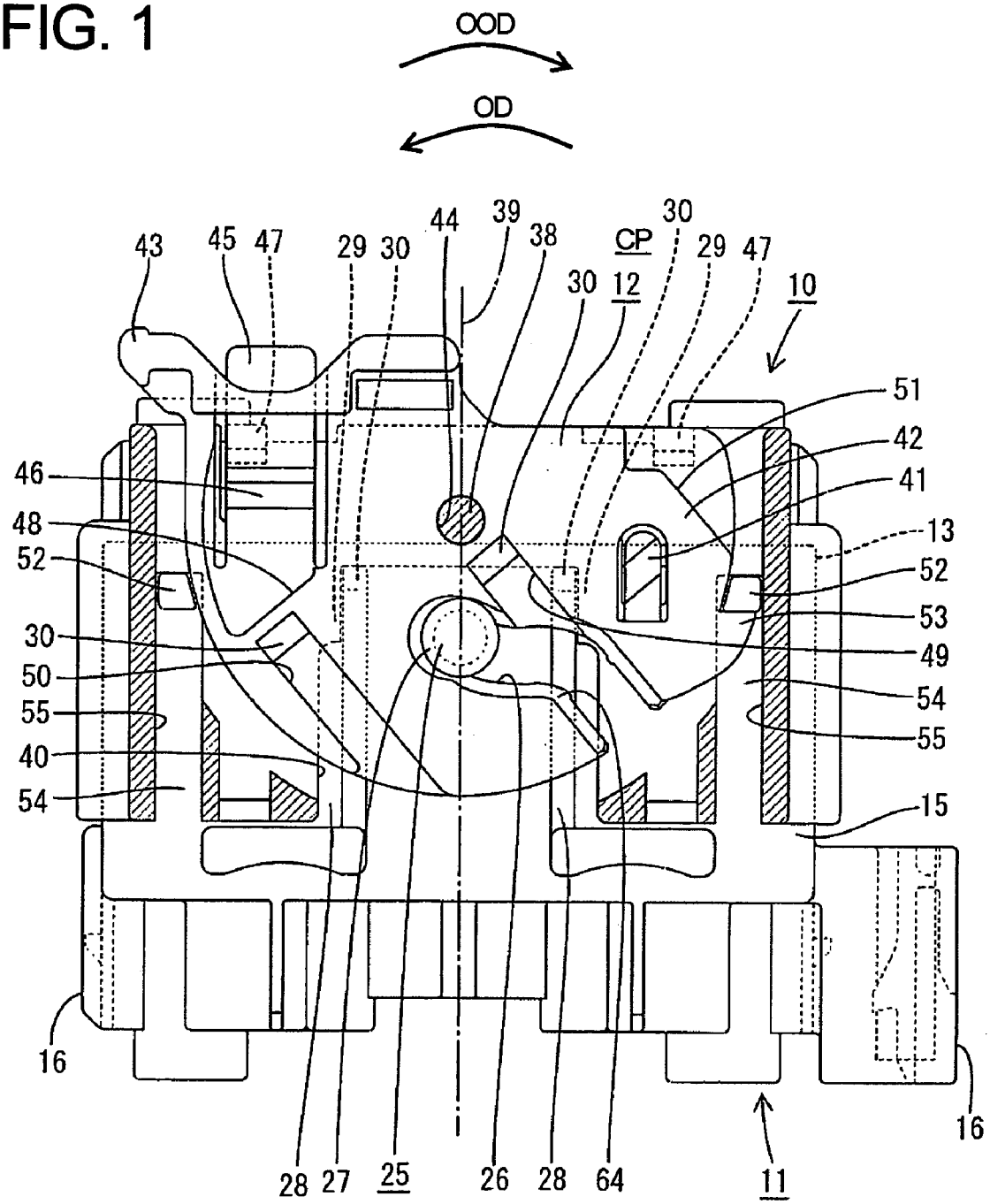
FIG. 1 is a plan view in section showing a properly connected state of a lever-type connector according to a first embodiment.

Mounting locks 16 are formed on the outer left and right side surfaces of the terminal accommodating portion 15 in FIG. 1 and are used to mount male housing 11 on the fixed member. As shown in FIG. 2, cavities 17 are formed in the terminal accommodating portion 15 and extend in forward and backward directions FBD. The male terminal fittings 14 can be inserted into the respective cavities 17 from behind. Each male terminal fitting 14 has a main portion 18 and a barrel 20 is provided behind the main portion 18. The barrel 20 can be crimped into connection with a wire 19. A long narrow tab 21 extends forward from the front end of the main portion 18. A resiliently deformable lock 22 is cantilevered forward from an inner wall of each cavity 17 and engages the main portion of the terminal fitting 14 to retain the male terminal fitting 14. The tab 21 projects into the receptacle 13 when the male terminal fitting 14 is accommodated in the cavity 17. A retainer 23 is mountable into a front-end of the terminal accommodating portion 15 to lock the male terminal fittings 14 doubly. A waterproof resilient plug 24 is fit on a rear part of the barrel 20 and surrounds the barrel 20 and an insulation coating of the wire 19. The outer peripheral surface of the waterproof resilient plug 24 closely contact the inner peripheral surface of the cavity 17 to provide sealing between the wire 19 and the inner peripheral surface of the cavity 17.

As shown in FIGS. 2 and 3, a substantially cylindrical cam pin 25 projects laterally up and substantially normal to the connecting direction CD. The cam pin 25 is near the front of the outer surface of the upper wall of the receptacle 13 and substantially in the transverse center in FIG. 3. A large-diameter portion 27 is formed at the upper end of the cam pin 25, and is enlarged in at least one radially direction of the cam pin 25. Two guiding ribs 28 project up at the left and right sides of the cam pin 25 and extend in substantially forward and backward directions FBD to guide the connecting and separating operations of the two housings 10, 11. A slanted surface 30 is formed at the front end of each guiding rib 28 and is inclined down to the front. A phantom straight line 39 (see FIG. 1) passes the widthwise center of the male housing 11 and substantially parallel with the connecting directions CD of the two housings 10, 11. The line 39 is an axis of symmetry, and the guiding ribs 28 are transversely symmetrical with respect to the axis of symmetry 39.

Figure 4:
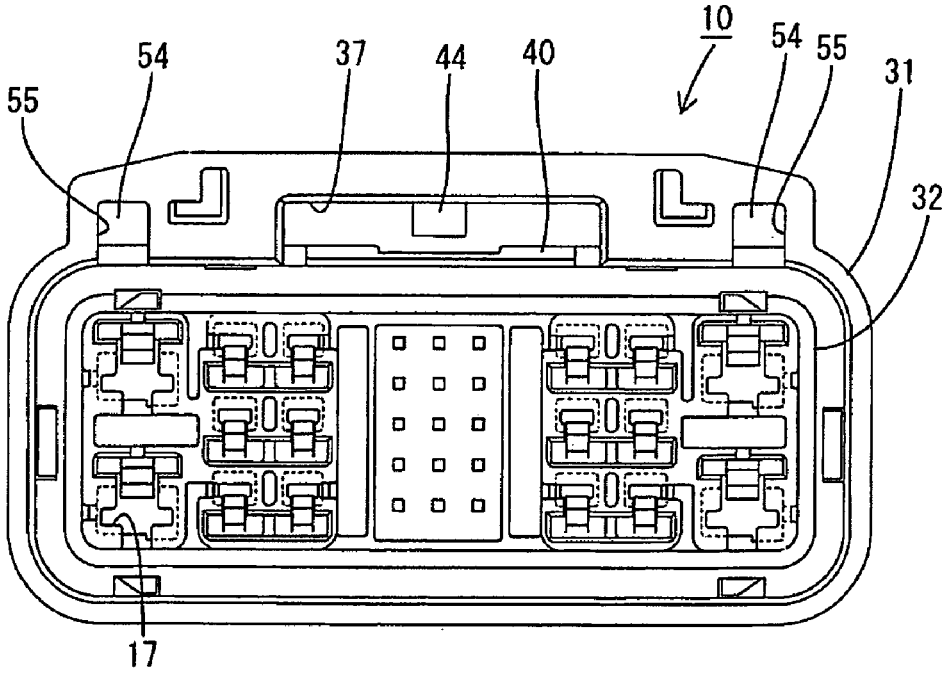
FIG. 4 is a front view of the female housing of the first embodiment.
Figure 5:
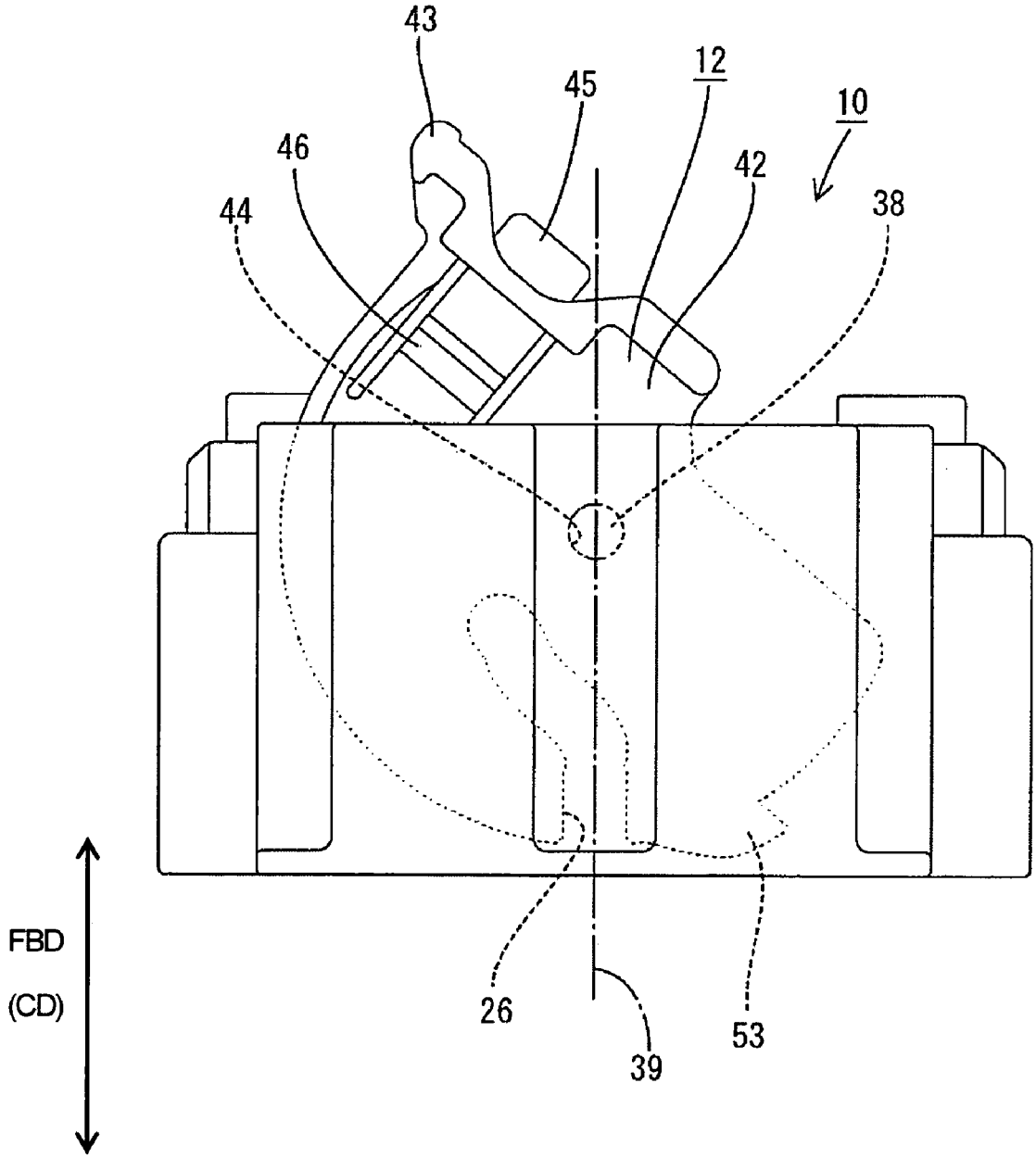
FIG. 5 is a plan view of the female housing of the first embodiment.

The female housing 10 is made e.g. of a synthetic resin and has an outer tube 31 and an inner tube 32 within the outer tube 31. Cavities 17 are formed substantially side by side along a width direction in the inner tube 32 and extend in forward and backward directions FBD at plural stages, as shown in FIGS. 2 and 4. Female terminal fittings 33 are inserted into the respective cavities 17 from behind, and are retained by a lock 22 in the cavity 17. Each female terminal fitting 33 is comprised of a substantially rectangular tube 34 for receiving the tab 21 of the male terminal fitting 14 in the male housing 11. A barrel 20 is provided behind the rectangular tube 34 and is crimped, bent or folded into connection with a wire 19. A resiliently deformable contact (not shown) is formed in the rectangular tube 34 for resiliently contacting the tab 21 inserted into the rectangular tube 34. A waterproof resilient plug 24 surrounds both the barrel 20 and the insulation coating of the wire 19. The plug 24 provides sealing between the wire 19 and the inner circumferential surface of the cavity 17 due to the close resilient contact between the outer surface of the plug 24 and the inner surface of the cavity 17. A substantially cap-shaped retainer 23 is mounted on a front-end portion of the inner tube 32 in the female housing 10 to lock the female terminal fittings 33 doubly. In this way, the female housing 10 is connected with the wires 19 forming a wiring harness and may serve as a harness-side or movable side housing.

The receptacle 13 of the male housing 11 is insertable into a clearance between the inner and out tubes 31 and 32. A tubular seal ring 35, made of resilient material such as rubber, is mounted on the outer peripheral surface of the inner tube 32 at a substantially middle part of the inner tube 32 with respect to forward and backward directions FBD. Sealing is provided between the female and male housings 10 and 11 by the close resilient contact between lips 36 formed around the outer peripheral surface of the seal ring 35 and the inner peripheral surface of the receptacle 13 of the male housing 11.

Figure 6:
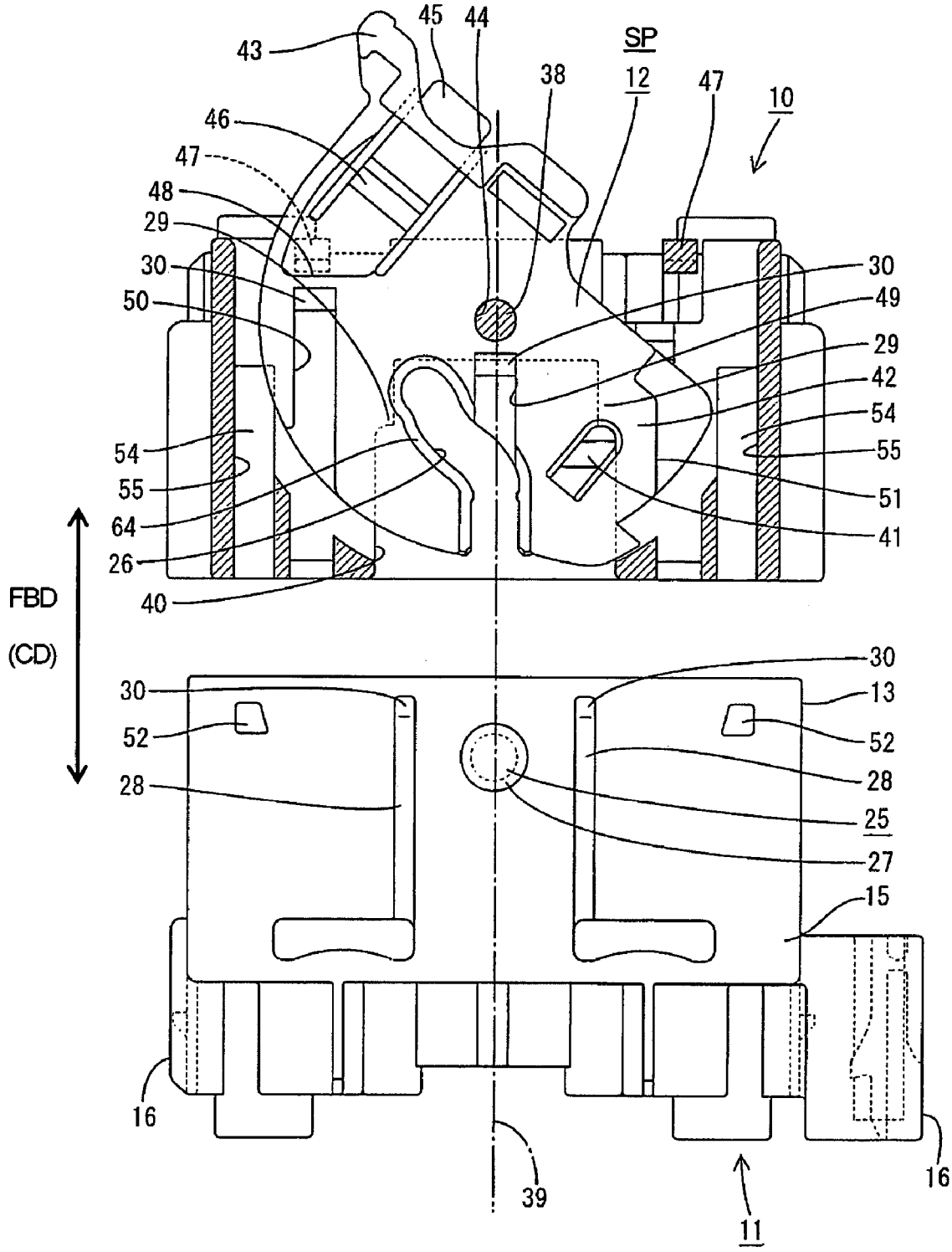
FIG. 6 is a plan view in section of the female housing and a plan view of the male housing of the first embodiment in a state where a lever is located at a standby position.

A lever accommodating space 37 is formed at an upper side of the outer tube 31 for accommodating the lever 12. A substantially cylindrical supporting shaft 38 extends down from the ceiling wall of the lever accommodating space 37. The lever accommodating space 37 is substantially transversely symmetrical with respect to the axis of symmetry 39 passing the center axis of the supporting shaft 38. As shown in FIG. 6, a substantially rectangular notch 40 is formed in the bottom wall of the lever accommodating space 37 as part of the outer tube 31 and extends back from the front edge. Substantially rectangular receiving portions 29 project in from the rear of the notch 40 and are substantially continuous with the opposite left and right walls of the notch 4 via quarter arcs. The receiving portions 29 are substantially transversely symmetrical with respect to the axis of symmetry 39.

As shown in FIG. 1, the lever 12 is made e.g. of a synthetic resin material and has a comb-shaped side plate 42 obtained by cutting off a rear-end area of the peripheral portion of a circle when viewed from above. An operable portion 43 bulges out laterally from the rear end of the side plate 42 at a left side in FIG. 1. The lever 12 is substantially vertically symmetrical and hence is symmetrical with respect to a plane substantially normal to the axis of rotation. This lever 12 is mounted in the lever accommodating space 37 of the female housing 10 for rotation between a standby position SP and a connected position CP. The standby position SP refers to a position of the lever 12 where the cam pin 25 on the male housing 11 can enter a cam groove 26 formed in the side plate 42 of the lever 12 (see FIG. 6). The connected position CP refers to as a position of the lever 12 where the two housings 10, 20 are connected properly (see FIG. 1). Reference is made to a state where the lever 12 is at the connected position CP concerning forward and backward directions FBD and the transverse direction in the description of the lever 12.

A shaft hole or recess 44 is formed to vertically penetrate the center of the side plate 42, and the aforementioned supporting shaft 38 is or can be at least partly inserted into this shaft hole 44. The cam groove 26 oblique to both circumferential direction and radial directions (or having a spiral-like shape) substantially centered on the shaft hole 44 is formed before the shaft hole 44 in the side plate 42. The cam-pin receiving portion 64 for receiving the larger-diameter portion 27 of the cam pin 25 is formed at the upper edge of the cam groove 26 over the entire length of the cam groove 26. The locking piece 41 for holding or positioning the lever 12 at the standby position SP is formed at a position of the side plate 42 at the lateral (right) side of the shaft hole 44. The locking piece 41 preferably is substantially in the form of a plate narrow and long in forward and backward directions FBD, and has the front end thereof supported on the side plate 42 while projecting backward. This resilient locking piece 41 is resiliently deformable upward and downward or inwardly and outwardly or towards and away from the housing 10 with the base end (front end) as a supporting point. The rear end of the locking piece 41 is engaged with the aforementioned receiving portion 29 when the lever 12 is at the standby position SP. Further, when the lever 12 is at the standby position SP (first position), the entrance of the cam groove 26 preferably is located substantially on the axis of symmetry 39 passing the supporting shaft 38 of the lever 12.

A resilient lock piece 45 is formed at the left rear of the side plate 42 and is a long narrow plate that extends substantially in forward and backward directions FBD. This resilient lock piece 45 is cantilevered back from its front end, and is resiliently deformable up and down towards and away from the housing 10. Outwardly projecting locks 46 are formed in the vicinity of a substantial center of the resilient lock piece 45 with respect to forward and backward directions FBD. Two return preventing portions 47 are formed at transversely symmetrical positions in the lever accommodating space 37. The lock projection 46 of the resilient lock piece 45 engages the lock projections 46 to hold the lever 12 at the connected position CP.

Holding steps 48 extend into both upper and lower surfaces of the side plate 42 near the resilient lock piece 45. The holding steps 48 engage the return preventing portion 47 to hold the lever 12 is at the standby position SP.

As shown in FIG. 1, supporting shaft escaping grooves 49 are formed in the upper and lower surfaces of the side plate 42 inwardly with respect to the thickness direction TD of the side plate 42. The supporting shaft escaping grooves 49 extend from a position slightly outward from the shaft hole 44 towards the entrance of the cam groove 26 for letting the supporting shaft 38 escape when the lever 12 is mounted in the female housing 10. A slanted surface 30 is formed at an end of each supporting'shaft escaping groove 49 towards the shaft hole 44 for facilitating movement of the supporting shaft 38 beyond a portion of the side plate 42 between the supporting shaft escaping groove 49 and the shaft hole 44. Further, as shown in FIG. 6, return-preventing portion escaping grooves 50 are formed in the upper and lower surfaces of the side plate 42. The return-preventing portion escaping grooves 50 extend forward from a position slightly before the holding steps 48 in FIG. 6 and accommodate the return preventing portion 47 upon mounting the lever 12 in the female housing 10. Further, a slanted surface 30 is formed near the rear edge of each return-preventing portion escaping groove 50 in FIG. 6 to facilitate movement of the return-preventing portion 47 beyond a portion of the side plate 42 between the holding step 48 and the return-preventing portion escaping groove 50. Recesses 51 are formed in the thickness direction TD of the side plate 42 of the lever 12 at a right rear end of the lever 12 in FIG. 1. The recesses 51 let the return-preventing portion 47 escape when the lever 12 is mounted into the female housing 10. A side wall of each recess 51 engages the return-preventing portion 47 to hold the lever 12 at the connected position CP.

As shown in FIGS. 3 and 6, two locking projections 52 project up near the left and right sides of the front end of the upper surface of the receptacle 13 of the male housing 11 and are transversely symmetrical with respect to the axis of symmetry 39 extending along forward and backward directions FBD and passing the center axis of the cam pin 25. The locking projections 52 are substantially trapezoidal in plan view, as shown in FIG. 6. The rear edges of the locking projections 52 are substantially straight along the transverse direction. The outer side surfaces of the locking projections 52 with respect to the transverse direction of the male housing 11 are substantially straight along forward and backward directions FBD. The inner side surfaces of the locking projections 52 with respect to the transverse direction of the male housing 11 have an arcuate contour substantially in conformity with the lateral edge of the lever 12 to let this lateral edge escape.

An engaging portion 53 projects out from the lateral edge of the side plate 42 at an end (right end in FIG. 1) of the lever 12 substantially opposite the operable portion 43. The rear edge of the engaging portion 53 is substantially straight along the transverse direction, and can align with the rear edges of the locking projections 52. Escaping holes 54 are formed in an end surface of the upper side of the outer tube 31 at a side to be connected with the male housing 11 for letting the locking projections 52 of the male housing 11 escape. The escaping holes 54 are substantially symmetrical with respect to the axis of symmetry 39 and extend in forward and backward directions FBD at positions corresponding to the locking projection 52 (see FIGS. 1 and 4). Guiding walls 54 are defined at the inner surfaces of the escaping holes 54 and slide in contact with the outer side walls of the locking projections 52 for guiding the connecting and separating operations of the two housings 10, 11.

The locking piece 41 engages the right receiving portion 29 and the holding step 48 engages the left return preventing portion 47 when the housings 10, 11 are in the state shown in FIG. 6. Thus, the lever 12 in the female housing 10 is held at the standby position SP and is not rotatable. In this state, the entrance of the cam groove 26 of the lever 12 faces forward and along the connecting direction CD to enable the cam pin 25 of the male housing 11 to enter the cam-groove 26.

Figure 7:
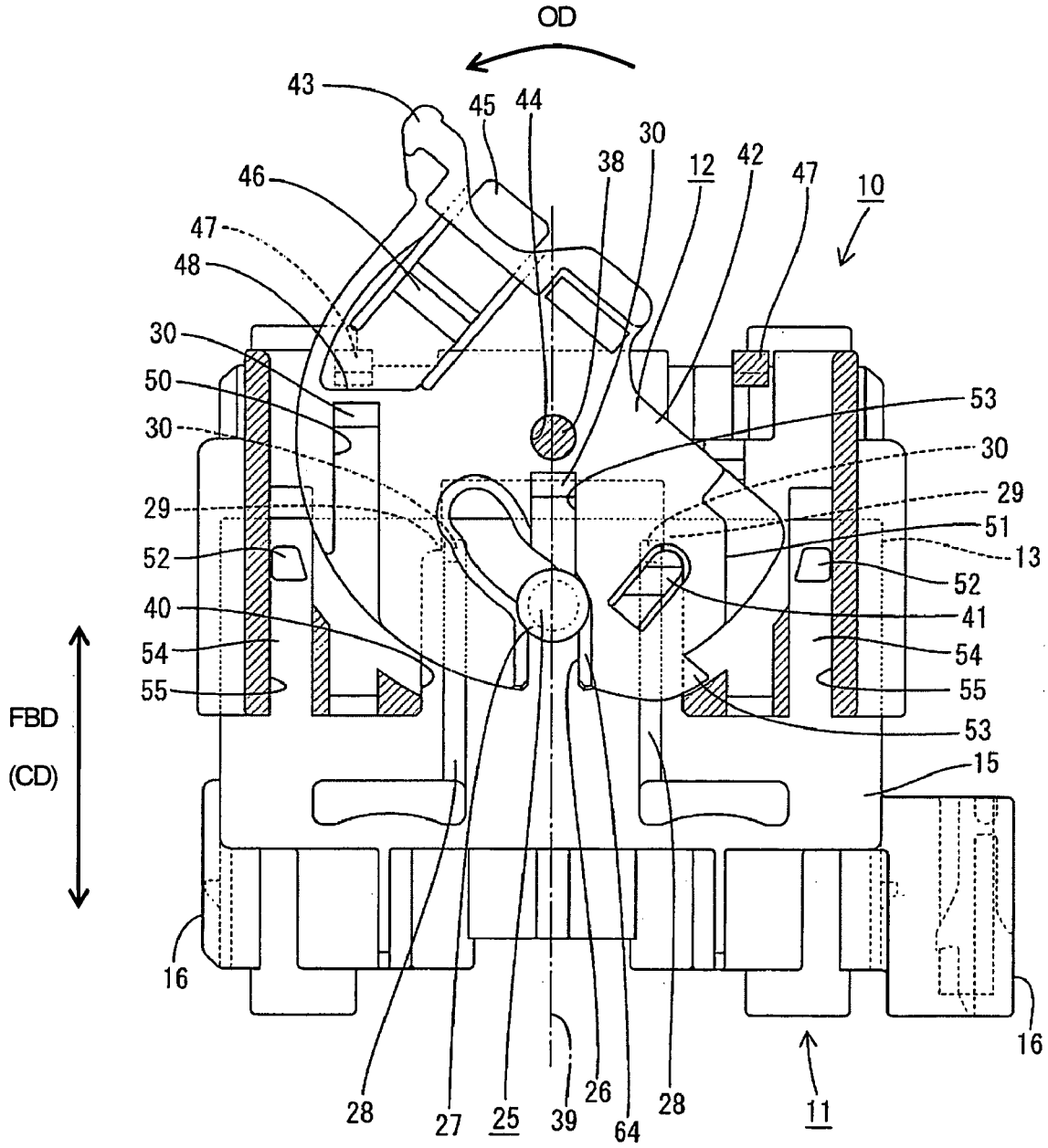
FIG. 7 is a plan view in section of the female housing and a plan view of the male housing of the first embodiment showing an initial state of a connecting operation of the two housings.

The two housings 10, 11 are moved to the state shown in FIG. 7 so that the cam pin 25 is at the entrance of the cam groove 26 of the lever 12. At this time, the guiding ribs 28 are in the notch 40. Additionally, the locking piece 41 moves onto the right guiding rib 28 and deforms resiliently up and out. As a result, the locking piece 41 and the right receiving portion 29 disengage, and the lever 12 is rotatable in the counterclockwise direction of FIG. 7 from the standby position SP. The outer side surfaces of the guiding ribs 28 slide in contact with the inner edges of the receiving portions 29 to guide the connecting operation of the two housings 10, 11.

Figure 8:
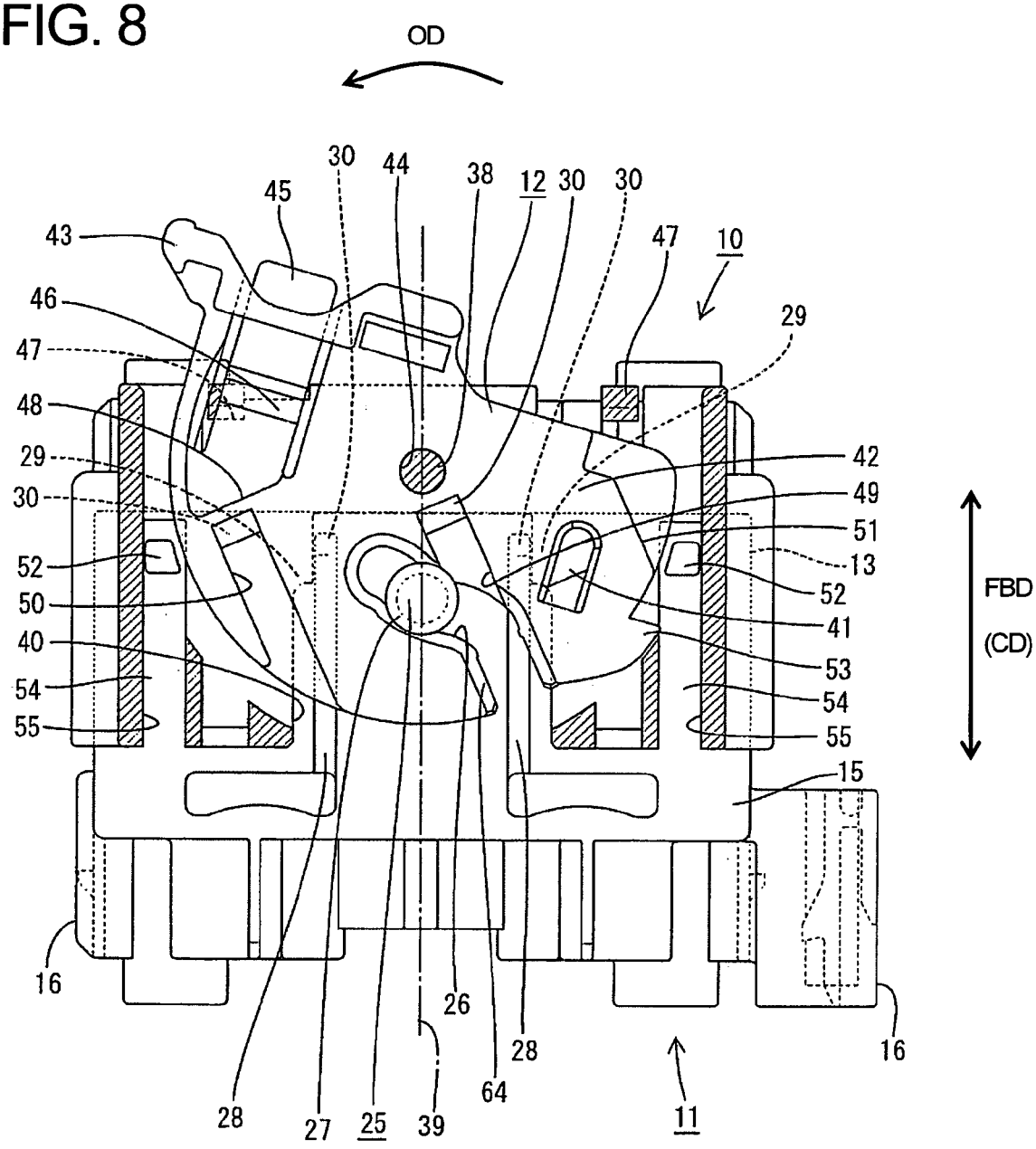
FIG. 8 is a plan view in section of the female housing and a plan view of the male housing of the first embodiment showing a state progressed from the connected state of FIG. 7.

The lever 12 then is rotated to the state shown in FIG. 8. As a result, the cam pin 25 is guided along the cam groove 26 of the lever 12 and moves toward the back side of the cam groove 26. Accordingly the female and male housings 10, 11 are displaced toward each other. Further, the lock projection 46 of the lever 12 moves onto the left return preventing portion 47, thereby causing the resilient lock piece 45 to deformed resiliently up.

The two housings 10, 11 are connected properly when the lever 12 is rotated to the connected position CP shown in FIG. 1. At this time, the lock projection 46 of the resilient lock piece 45 of the lever 12 engages the left return preventing portion 47 to prevent clockwise rotation of the lever 12, and the recess 51 engages the right return preventing portion 47 to prevent counterclockwise rotation of the lever 12. Further, the engaging portion 53 exerts a force on the right locking projection 52 in the connecting direction CD of the male housing 11 to correct the postures of the two housings 10, 11. Additionally, the front edges of the locking projection 52 contact the rear edges of the escaping holes 54 and the front edges of the guiding ribs 28 contact the rear edge of the notch 40 to prevent further forward movements of the two housings 10, 11.

The lever 12 is held substantially in the orientation of the standby position SP and is inserted into the lever accommodating space 37 from behind. The ceiling wall of the lever accommodating space 37 deforms during this process so that the lever 12 can be mounted into the female housing 10. At this time, the left return preventing portion 47 in FIG. 1 enters the return preventing portion escaping groove 50 of the lever 12, the right return preventing portion 47 in FIG. 1 enters the recess 51 of the lever 12, and the supporting shaft 38 passes the cam groove 26 of the lever 12 and enters the supporting shaft escaping groove 49. In this way, connection resistance between the lever 12 and the female housing 10 is reduced to facilitate mounting lever 12. The slanted surfaces 30 of the return preventing portion escaping grooves 50 and the supporting shaft escaping grooves 49 enable the return preventing portions 47 and the supporting shaft 38 to move easily onto the corresponding parts.

The supporting shaft 38 moves onto the slanted surface 30 at the rear edge of the supporting shaft escaping groove 49 as the lever 12 is inserted farther to the back of the lever accommodating space 37 and then fits into the shaft hole 44. At this time, the left return preventing portion 47 in FIG. 1 moves onto the slanted surface 30 at the rear edge of the return preventing portion escaping groove 50. The return preventing portion 47 then restores resiliently and contacts the holding step 48 from behind. As a result, the lever 12 is prevented from rotating in the clockwise direction of FIG. 1. Further, the locking piece 41 contacts the right receiving portion 29 to prevent the lever 12 from moving in the opposite counterclockwise direction of FIG. 1. In this way, the lever 12 is held at the standby position SP and is prevented from rotating in both forward and reverse directions.

The receptacle 13 of the male housing 11 can be fit lightly into the female housing 10 in this state. As a result, the cam pin 25 enters the entrance of the cam groove 26, as shown in FIG. 7. At this time, the locking projections 52 enter the respective escaping holes 54 and the outer side surfaces of the locking projections 52 slide in contact with the guiding walls 55 of the escaping holes 54 for guiding the connecting operation of the two housings 10, 11. Further, the guiding ribs 28 enter the notch 40 and the front end of the right guiding rib 28 contacts the locking piece 41. The locking piece 41 moves onto the right guiding rib 28 and is deformed resiliently up. Thus, the locking piece 41 and the right receiving portion 29 are disengaged, and the lever 12 can rotate in the counterclockwise direction of FIG. 7. The slanted surface 30 enables the locking piece 41 to move easily onto the right guiding rib 28.

The operable portion 43 can be pushed to rotate the lever 12 counterclockwise about the supporting shaft 38 and to the position shown in FIG. 8. As a result, the cam pin 25 is guided along the cam groove 26 and the two housings 10, 11 are pulled together in the connecting directions CD. In this state, the lock projection 46 moves onto the left return preventing portion 47, and hence the resilient lock piece 45 starts being deformed up. Further, the connecting operation of the housings 10, 11 is guided by the sliding contact of the outer side surfaces of the guiding ribs 28 with the inner edges of the receiving portions 29.

Figure 9:
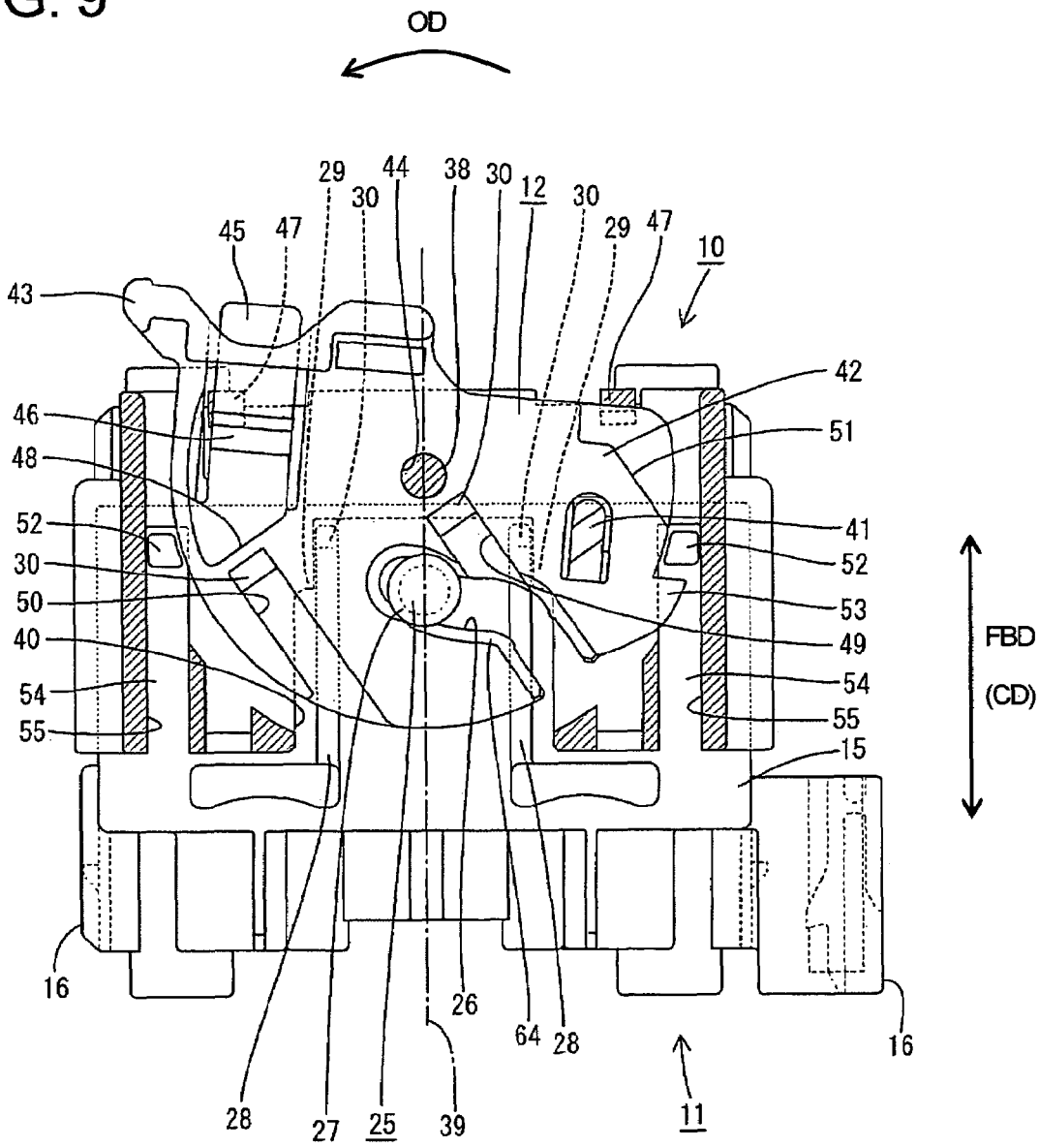
FIG. 9 is a plan view in section of the female housing and a plan view of the male housing of the first embodiment immediately before the housings are properly connected.

The operable portion 43 of the lever 12 is at the left rear side of the female housing 10, as shown in FIG. 9, immediately before the two housings 10, 11 are connected properly. The female housing 10 receives a force in the connecting direction CD (down in FIG. 9) if the operable portion 43 of the lever 12 is pushed in this state. This force could cause the left side of the female housing 10 in FIG. 9 to precede the right side and could cause the female housing 10 to assume an inclined posture.

The engaging portion 53 engages the right locking projection 52, as shown in FIG. 1, if the operable portion 43 is pushed in the state described above. Thus, the engaging portion 53 exerts an upward force on the right locking projection 52 along the connecting direction CD. As a result, a force acts at the right side of the inclined female housing 10 (e.g. inclined down to left in FIG. 9) to insert the male housing 11 in a substantially correct posture. The connecting operation is completed with the two housings 10, 11 in their proper postures by pushing the operable portion 43. In the resulting state, the resilient lock piece 45 is restored resiliently and the lock projection 46 thereof engages the left return preventing portion 47 to prevent the lever 12 from rotating in the clockwise direction of FIG. 1. Further, the right return preventing portion 47 in FIG. 1 and the side wall of the recess 51 engage to prevent the lever 12 from rotating in the counterclockwise direction of FIG. 1. The front edges of the locking projections 52 contact the rear edges of the escaping holes 54 and the front edges of the guiding ribs 28 contact the rear edge of the notch 40 to prevent any further forward movements of the two housings 10, 11.

The resilient lock piece 45 can be pushed up by finger, jig or the like and deformed resiliently to separate the two locked housings 10, 11. As a result, the lock projection 46 disengages from the left return preventing portion 47 and permits the lever 12 to be rotated from the connected position CP towards the standby position SP. The lever 12 is rotated in the clockwise direction of FIG. 1 by holding the unlocked operable portion 43. Then, the cam pin 25 is guided along the cam groove 26 and the two housings 10, 11 are displaced in separating directions. The two housings 10, 11 reach the state shown in FIG. 7 when the lever 12 reaches the standby position SP and the two a housings 10, 11 may be separated from each other.

The lever 12 is mounted in the female housing 10 for movement in an operation direction OD from the standby position SP towards the connected position CP. Additionally, the operable portion 43 is at the left end of the female housing 10 when the lever 12 is at the connected position CP. Thus, the lever 12 also can be mounted in the female housing 10 in a posture transversely reversed from the posture described above. More particularly, the lever 12 has a substantially vertically symmetrical shape. The entrance of the cam groove 26 is substantially on the axis of symmetry 39 passing the supporting shaft 38 of the lever 12 when the lever 12 is at the standby position SP. The return preventing portions 47 are arranged at two substantially transversely symmetrical positions with respect to the axis of symmetry 39. Furthermore, the locking projections 52 are arranged at two substantially transversely symmetrical positions with respect to the axis of symmetry 39. The escaping holes 54 are at two substantially transversely symmetrical positions with respect to the axis of symmetry 39 and the guiding ribs 28 are at two substantially transversely symmetrical positions with respect to the axis of symmetry 39; and/or the receiving portions 29 project inward substantially transversely symmetrically with respect to the axis of symmetry 39.

The lever 12 can be mounted in a posture transversely reversed from the posture described above. Thus, the lever 12 is mounted in the female housing 10 for clockwise rotation and in an opposite operating direction OOD to the operating direction described above from the standby position SP to the connected position CP. Accordingly, the operable portion 43 is at the opposite or right end when the lever 12 is at the connected position CP. The procedure of connecting the two housings 10, 11 by rotating the lever 12 from the standby position SP to the connected position CP is transversely symmetrical with the procedure described above, and hence the functions are not described.

As described above, the lateral side of the female housing 10 near the operable portion 43 of the lever 12 may precede the lateral side opposite to the operable portion 43 of the lever 12 immediately before the two housings 10, 11 are connected properly. However, the engaging portion 53 at the side of the lever 12 opposite the operable portion 43 engages the locking projection 52 and exerts a force along the connecting direction CD of the male housing 11. Therefore, the posture of the female housing 10 is corrected, and the housings 10, 11 can be connected in their substantially proper postures.

Further, the locking projections 52 of the female housing 10 slide in contact with the guiding walls 55 in the male housing 11 to guide the connecting and separating operations of the two housings 10, 11. Thus, the two housings 10, 11 can be connected, in their substantially proper postures.

Furthermore, the lever 12 can be mounted into the female housing 10 in either of two postures transversely symmetrical with respect to the axis of symmetry 39. Thus, the rotating efficiency of the lever 12 can be improved by selecting the mounted posture of the lever 12 depending on a situation where the connector is arranged.

A second embodiment of the invention is described with reference to FIGS. 10 and 11. A lever-type connector according to this embodiment has a first housing 56 and a second housing 57 that are connected and separated by a lever 12 in the first housing 56. It should be noted that ends of the housings 10, 11 to be connected are referred to herein as front ends.

The second housing 57 projects out from a wall of a fixed member 63 and is a waiting-side housing. Two substantially cylindrical cam pins 25 are formed on an outer surface of the upper wall of the second housing 57 near the front end. The cam pins 25 are at positions substantially transversely symmetrical with respect to an axis of symmetry 39 passing the widthwise or transverse center of the second housing 57 and substantially in parallel with connecting directions of the two housings 56, 57. A large-diameter portion 27 is formed at the distal end of each cam pin 25.

The first housing 56 is to be connected with wires 19 of a wiring harness and hence is a harness-side housing. Two substantially cylindrical supporting shafts 38 are formed at positions of the outer surface of the upper wall of the first housing 56 near the rear end. The supporting shafts 38 are at positions substantially transversely symmetrical with respect to the axis of symmetry 39 passing the widthwise or transverse center of the first housing 56 and are substantially parallel with the connecting directions of the housings 56, 57. Two protrusions 58 project laterally to the left and right from the distal end of each supporting shaft 38.

A substantially rectangular notch 40 is formed near the transverse center of a front side of the upper wall of the first housing 56. The notch 40 extends back from the front edge and is substantially transversely symmetrical with respect to the axis of symmetry 39. Left and right plate-like pressing portions 59 are provided at the opposite left and right sides of the notch 40. Both pressing portions 59 are substantially rectangular and are narrow and long along the transverse direction. The pressing portions 59 are substantially parallel with the upper wall of the first housing 56. A notch is formed at a rear-left corner of the right pressing portion 59 to prevent the interference with the lever 12, and an eave 60 is formed for pressing a bulge 62 of the lever 12 from above, as described later. Similarly, a notch is formed at a rear-right corner of the left pressing portion 59 to prevent the interference with the lever 12, and another eave 60 is formed for pressing the bulge 62 of the lever 12 from above.

Figure 10:
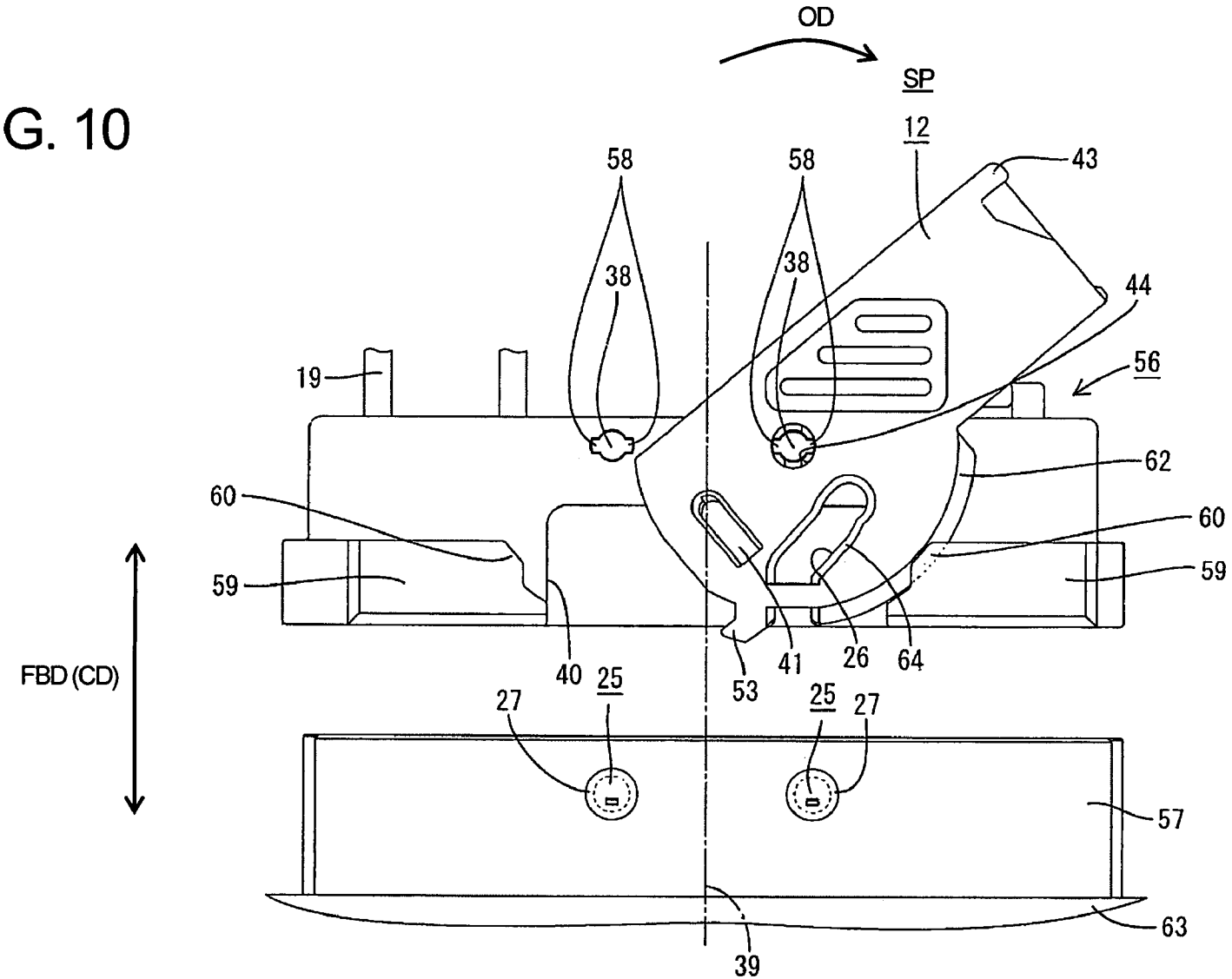
FIG. 10 is a plan view of a first housing and a second housing showing a state where a lever is located at a standby position in a lever-type connector according to a second embodiment.
Figure 11:
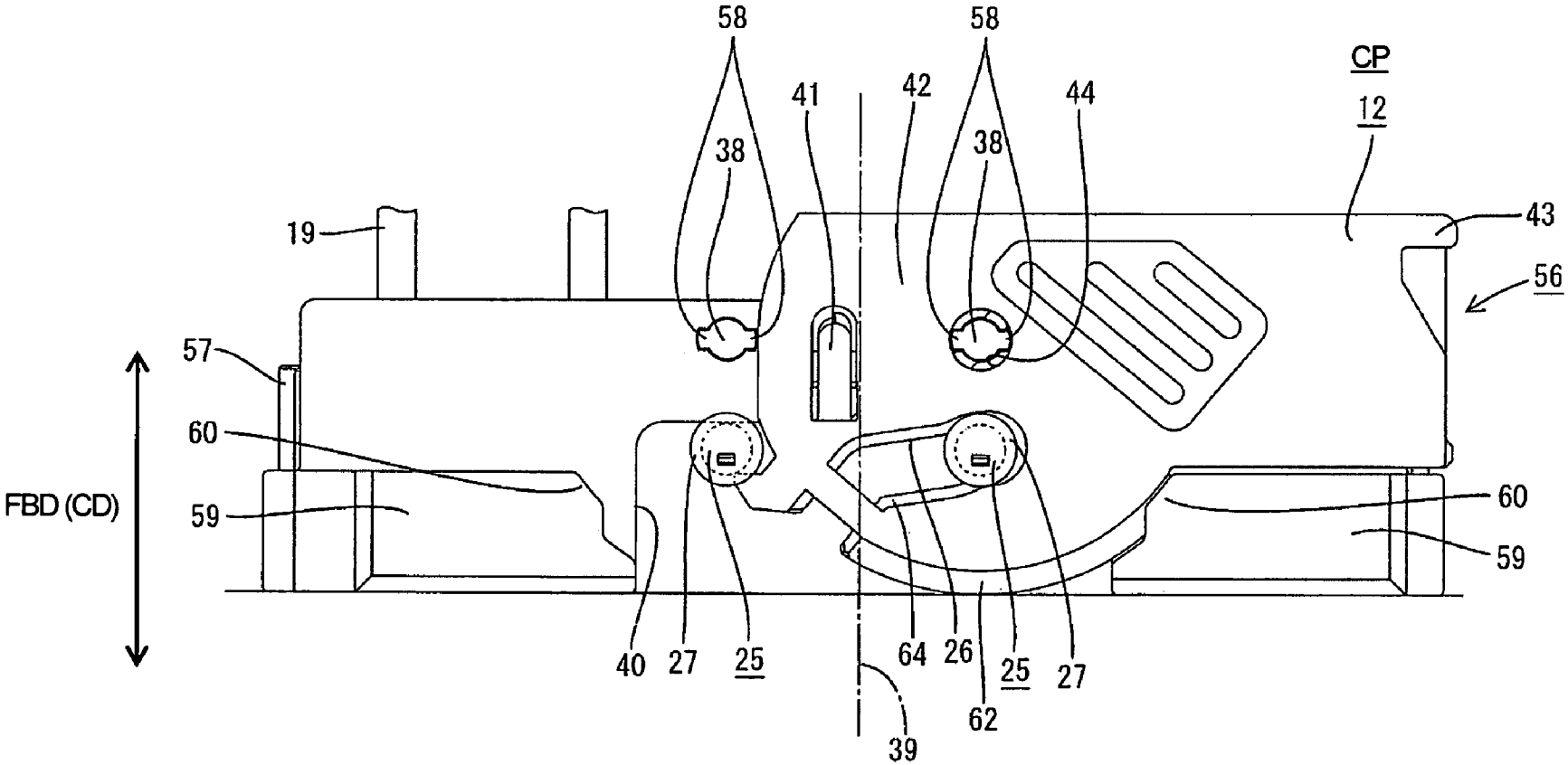
FIG. 11 is a plan view showing a properly connected state of the lever-type connector according to the second embodiment.

As shown in FIG. 10, the lever 12 has a substantially comb-shaped side plate 42 obtained by cutting off a rear-end area of the peripheral portion of a circle when viewed from above. A substantially rectangular operable portion 43 projects out to the right from the right end of the side plate 42. The lever 12 is substantially vertically symmetrical. The lever 12 is mountable on the right supporting shaft 38 in FIG. 10 on the first housing 56 and is rotatable between a standby position SP and a connected position CP. Reference is made to a state where the lever 12 is at the connected position (see FIG. 10) concerning forward and backward directions and transverse direction in the description of the lever 12.

A shaft hole 44 vertically penetrates the center of the side plate 42, and has a shape conforming to the shape of the supporting shafts 38. Thus, one of the supporting shafts 38 may be inserted into the shaft hole 44. A round hole (not shown) is formed outside the: shaft hole 44 to let the protrusions 58 of the supporting shaft 38 escape when the lever 12 is rotated. A cam groove 26 is formed in the side plate 42 near the shaft hole 44 and extends oblique to both circumferential and radial directions substantially centered on the shaft hole 44. A cam-pin receiving portion 64 for receiving the large-diameter portion 27 of the cam pin 25 is formed at the upper edge of the cam groove 26 over substantially the entire length of the cam groove 26. A locking piece 41 is formed in the side plate 42 at the left side of the shaft hole 44 and holds the lever 12 at the standby position SP. The locking piece 41 is a plate that is long and narrow in forward and backward directions FBD and is cantilevered rearwardly. The locking piece 41 is resiliently deformable up and down towards and away from the housing 10 with the front end as a support. The rear end of the locking piece 41 is engaged with the rear edge of the notch 40 when the lever 12 is at the standby position SP. An arcuate bulge 62 bulges radially out at the front edge of the side plate 42 and is substantially concentric with the side plate 42. The upper surface of the bulge 62 is lowered with respect to the upper surface of the side plate 42 to form a step.

A substantially hook-shaped engaging portion 53 is formed at the left side of the entrance of the cam groove 26 of the side plate 42 and projects radially out from the lateral edge of the side plate 42. The rear edge of the engaging portion 53 is engageable with the left cam pin 25 of FIG. 11 with the lever 12 at the connected position CP. Thus, the engaging portion 53 is engageable with the cam pin 25 on which the shaft hole 44 of the lever 12 is not-arranged when the lever 12 is at the connected position CP.

The lever 12 is aligned so that the shaft hole 44 can receive the protrusions 58 of the supporting shaft 38 and then the supporting shaft 38 is inserted into the shaft hole 44. The lever 12 then is rotated to the standby position SP (see FIG. 10). As a result, the leading end of the locking piece 41 contacts the rear edge of the notch 40. Unillustrated holding means prevents the lever 12 from rotating in either forward or reverse directions. At this time, the right pressing portion 59 is above the bulge 62 to prevent an upward displacement of the lever 12.

In this state, the second housing 57 is fit lightly into the first housing 56 so that the right cam pin 25 in FIG. 10 enters the cam groove 26. An unillustrated unlocking portion then contacts the locking piece 41 and deforms the locking piece 41 up and out. Thus, the locking piece 41 is disengaged from the notch 40 and the lever 12 can rotate clockwise in an operating direction OD as shown in FIG. 10.

The operable portion 43 is pushed in this state to rotate the lever 12 clockwise in the operating direction OD about the right supporting shaft 38. Thus, the right cam pin 25 is guided substantially along the cam groove 26, and the two housings 56, 57 are pulled towards each other along the connecting directions CD thereof. As the connecting operation progresses farther, the engaging portion 53 engages the left cam pin 25, as shown in FIG. 11. As a result, the engaging portion 53 exerts a force on the left cam pin 25 that acts up in FIG. 11 and substantially along the connecting direction CD of the second housing 57. In this way, the posture of the second housing 57 can be corrected. The connecting operation is completed by pushing the operable portion 43 in this state with the two housings 56, 57 held substantially in their proper postures. An opposite counterclockwise rotation of the lever 12 in FIG. 11 can be prevented by unillustrated lever holding means. Further, any further forward movements of the two housings 56, 57 are prevented by the contact of the front ends of the cam pins 25 with the rear edge of the notch 40.

In the above description, the lever 12 is mounted in the first housing 56 so that the lever 12 is on the right supporting shaft 38 in FIG. 10 and rotated clockwise in the operating direction OD from the standby position SP towards the connected position CP. Thus, the operable portion 43 is at the right end when the lever 12 is at the connected position CP. However, the lever 12 may also be mounted on the other left supporting shaft 38 and mounted in the first housing 56 in a posture transversely reversed from the above one in this embodiment. At this time, the engaging portion 53 is engageable with the right cam pin 25.

The lever 12 can be mounted in the posture transversely reversed from the posture described above. Thus, the lever 12 is rotated counterclockwise and opposite to the above-described operating direction OD from the standby position towards the connected position. Additionally, the operable portion 43 is at the opposite left end when the lever 12 is at the connected position. A procedure of connecting the two housings 56, 57 by rotating the lever 12 from the standby position to the connected position after the lever 12 is mounted into the first housing 56 is transversely symmetrical with the above-described procedure, the functions are not described.

The lever 12 engages the cam pin 25 not engaged with the cam groove 26 when the lever 12 is at the connected position CP. Thus, the construction of the second housing 57 is simpler as compared to a case where the locking projections 52 are provided separately.

The invention is not limited to the above described and illustrated embodiments. For example, the following embodiments are also embraced by the technical scope of the present invention as defined by the claims. Beside the following embodiments, various changes can be made without departing from the scope and spirit of the present invention as defined by the claims.

The lever 12 is plate-like in the first embodiment. However, the lever 12 may be substantially U-shaped by connecting ends of a pair of side plates 42 by an operable portion 43 or may be L- or V-shaped. In such a case, the posture of the female housing 10 can be corrected at both the upper side and the lower sides. Thus, the postures of the two housings 10, 11 being connected can be stabilized better.

The lever 12 is mountable in two transversely reversed postures with respect to the axis of symmetry 39 in the first embodiment. However, the lever 12 can be mountable only in one transverse posture. In some cases, only one locking projection 52 is formed.

The escaping holes 54 and the guiding walls 55 for letting the locking projections 52 escape and guiding the locking projections 52 are formed in the end of the female housing 10 that is connected with the male housing 11 in the first embodiment. However, material of the female housing 10 may be removed at positions corresponding to the locking projections 52 to let the locking grooves 52 escape.

The first housing is the female housing 10 and the second housing is the male housing 11 in the first embodiment. However, the first housing may be the male housing 11 and the second housing may be the female housing 10.

The male housing 11 is fixed to the fixed member by means of the mounting lock portions 16 in the first embodiment. However, the male housing 11 may project from a wall surface of the fixed member.

The operable member was described as a lever rotatably provided on the first housing. However, the invention is equally applicable to movable members having different operation paths, such as a slider with a substantially linear displacement path or to any other movable member having different moving paths, such as bent, elliptic or the like paths or combined paths.

What is claimed is:

1. An electrical connector, comprising: a housing and a movable member mounted on the housing for rotation relative to the housing about an axis of rotation, the movable member having a side plate with an operable portion positioned at a first end of the movable member that is spaced from the axis of rotation, the side plate having at least one cam engageable with at least one mating cam formed on a mating housing so that the mating cam can be guided along the cam as the movable member is rotated about the axis for connecting the housing with the mating housing, an engaging portion formed at a second end of the movable member that is substantially opposite to the operable portion so that the axis of rotation is substantially between the operable portion and the engaging portion, the engaging portion being disposed for engaging a locking projection on the mating housing immediately before the housing is connected properly with the mating housing so that the engaging portion exerts a force on the locking projection in a direction along a connecting direction of the mating housing as the movable member is operated, whereby the force exerted by the engaging portion corrects any inclination of the housing caused by forces exerted on the operable portion so that the housing and the mating housing are connected in a substantially correct posture.

2. The electrical connector of claim 1, wherein the movable member is operated substantially along a connecting direction of the housing immediately before the housings are connected properly.

3. The electrical connector of claim 1, wherein the housing is connected with wires of a wiring harness, and the mating housing disposed on a fixed member.

4. An electrical connector assembly comprising the connector of claim 1 and a mating connector having the mating connector housing, the locking projection being formed on the mating housing.

5. The electrical connector of claim 1, wherein the engaging portion is a surface facing substantially opposite to the connecting direction of the housing immediately before the housing and the mating housing are connected properly.

6. An electrical connector, comprising: a housing and a movable member movably mounted on the housing, the movable member having a side plate with an operable portion, the side plate having at least one cam engageable with at least one mating cam formed on a mating housing so that the mating cam can be guided along the cam as the movable member is operated for connecting the housing with the mating housing, an engaging portion formed at an end of the movable member substantially opposite to the operable portion, the engaging portion being disposed for engaging a locking projection on the mating housing immediately before the housing is connected properly with the mating housing so that the engaging portion exerts a force on the locking projection in a direction along a connecting direction of the mating housing as the movable member is operated, wherein at least one guiding wall is formed on the housing and extends substantially in the connecting direction of the two housings, the guiding wall being disposed for sliding contact with the locking projection during a connecting operation of the two housings.

7. An electrical connector assembly, comprising: first and second housings configured for connection with one another along a connecting direction, the second housing being formed with a cam and with a locking projection spaced from the cam in a direction substantially transverse to the connecting direction, a movable member mounted on the first housing for rotation about an axis of rotation, the movable member having a side plate with an operable portion positioned at a first end of the movable member that is spaced from the axis of rotation, the side plate having at least one cam groove engageable with the cam on the second housing so that the cam on the second housing can be guided along the cam groove as the movable member is rotated for connecting the first housing with the second housing, an engaging portion formed at a second end of the movable member that is substantially opposite to the operable portion so that the axis of rotation is substantially between the operable portion and the engaging portion, the engaging portion being disposed for engaging the locking projection on the second housing immediately before the first housing is connected properly with the second housing, the engaging portion being aligned for exerting a force on the locking projection in a direction for urging the first housing towards the second housing along the connecting direction as the movable member is rotated, whereby the force exerted by the engaging portion corrects any inclination of the first housing caused by forces exerted on the operable portion so that the first housing and the second housing are connected in a substantially correct posture.

* * * * *